US006390707B2

(12) United States Patent
Kageyama et al.

(10) Patent No.: US 6,390,707 B2
(45) Date of Patent: May 21, 2002

(54) KNOCKING WRITING UTENSIL

(75) Inventors: Hidehei Kageyama; Yoshio Noguchi, both of Kawagoe (JP)

(73) Assignee: Kotobuki & Co., Ltd., Kyoto (JP)

( * ) Notice: Subject to any disclaimer, the term of this patent is extended or adjusted under 35 U.S.C. 154(b) by 0 days.

(21) Appl. No.: 09/742,108

(22) Filed: Dec. 22, 2000

Related U.S. Application Data

(62) Division of application No. 09/361,204, filed on Jul. 27, 1999, now Pat. No. 6,227,734.

(30) Foreign Application Priority Data

Jul. 27, 1998 (JP) ..... 10-211655
Jul. 5, 1999 (JP) ..... 11-190931

(51) Int. Cl.[7] ..... B43K 5/16
(52) U.S. Cl. ..... 401/104; 401/109
(58) Field of Search ..... 401/104, 105, 401/109, 110, 111, 112, 113, 114, 106

(56) References Cited

U.S. PATENT DOCUMENTS 1,583,718 A * 5/1926 Hudson ..... 401/104
3,130,710 A * 4/1964 Hansen et al. ..... 401/106

FOREIGN PATENT DOCUMENTS

DE 92 04 124 U 5/1993
DE 43 29 772 A1 3/1995
FR 2 747 612 10/1997

* cited by examiner

*Primary Examiner*—David J. Walczak
(74) *Attorney, Agent, or Firm*—McGinn & Gibb, PLLC

(57) ABSTRACT

A knocking writing utensil which automatically returns a writing medium to a withdrawn position when a clip is used, includes an engagingly-locking protrusion formed on an engagement body that moves inside an external cylinder together with a refill. An engaging-lock receiving protruding portion including an engaging-lock receiving portion at its front end is formed on the rear surface of a non-proximal end of a clip with its proximal end fixed to the external cylinder. A guide hole is formed in the external cylinder so as to correspond to the engaging-lock receiving protruding portion. A cam portion for abutting on the engagingly-locking protrusion is formed on a knock bar integrated with a knock body. The cam portion moves the engagingly-locking protrusion beyond the engaging-lock receiving protruding portion from behind it to the engaging-lock receiving portion, or guides the engagingly-locking protrusion from the engaging-lock receiving portion to behind the engaging-lock receiving protruding portion so as to pass by one lateral side of the engaging-lock receiving protruding portion.

18 Claims, 16 Drawing Sheets

FIG.4A
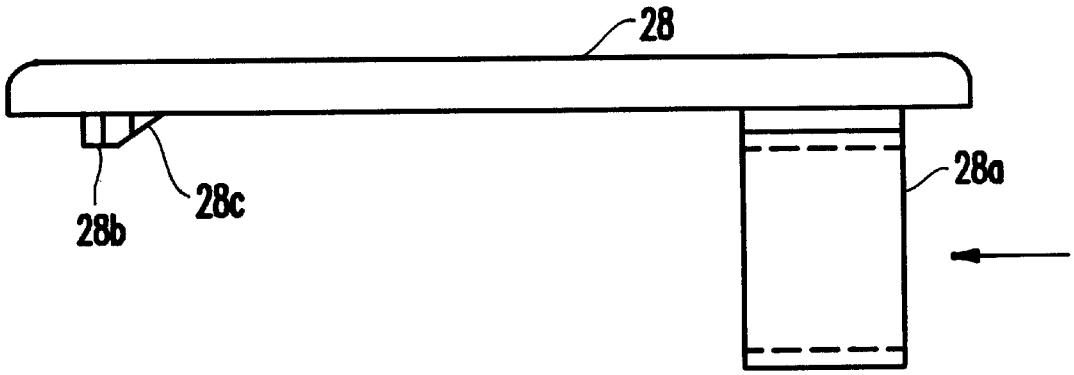
FIG.4B
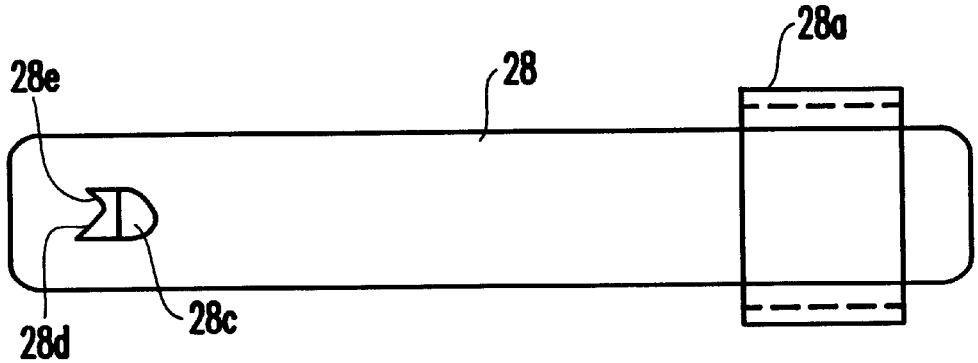
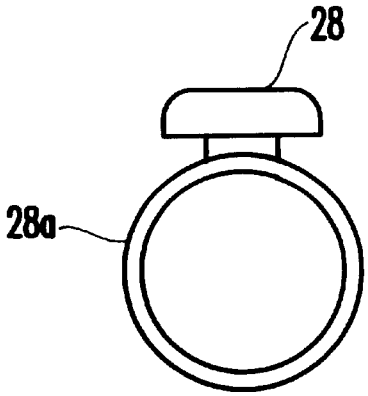
FIG.4C

KNOCKING WRITING UTENSIL

The present application is a Divisional Application of U.S. patent application Ser. No. 09/361,204, filed on Jul. 27, 1999 now U.S. Pat. No. 6,227,734.

BACKGROUND OF THE INVENTION

1. Field of the Invention

The present invention relates to a knocking writing utensil such as a ball-point pen, a mechanical pencil, or a marker, that uses a knocking operation to move a writing medium to a forward position in which the tip of the writing medium protrudes from the tip of an external cylinder.

2. Description of the Related Art

A conventional knocking writing utensil includes an external cylinder, a writing medium inserted and housed in the external cylinder so as to be moved in the axial direction, an elastic body for urging the writing medium rearward, a clip with its proximal end fixed to the external cylinder, and a knock body that is exposed outwardly from the external cylinder to be easily knocked (e.g., actuated, depressed, etc.). The knock body is operated to move the writing medium from a withdrawn position within the external cylinder to a forward position where the writing medium tip protrudes from the tip of the external cylinder.

If a user forgets to withdraw the writing medium into the external cylinder and clips the conventional writing utensil to the edge of their jacket pocket for instance, then the writing medium may stain their clothing or make a hole therein.

A knocking writing utensil that solves this problem is described in the applicant's Japanese Utility Model Publication No. 5-25915 and Japanese Utility Model Publication No. 6-15735.

In these knocking writing utensils, a clip is integrated with a knock body protruding from the rear end portion of an external cylinder. An engagingly-locking protrusion is provided on the rear surface of the tip of the clip so as to engage an engaging-lock receiving portion formed on the external cylinder to hold a writing medium at a forward position.

In this knocking writing utensil, when the user attempts to separate the tip of the clip from the external cylinder, in order to insert the clip on a pocket, the engagingly-locking protrusion is disengaged from the engaging-lock receiving portion to automatically withdraw the writing medium. This prevents a garment, and an attached pocket, from being stained or damaged. However, since the clip moves in response to the knocking of the knock body, knocking the knock body is impossible while the clip is in a gripping position. Thus, with this type of writing utensil, a knocking operation is difficult.

Furthermore, to return the writing medium to the withdrawn position, both ends of the clip must be rocked up and down, and the knocking operation of the knock body does not allow the writing medium to return to its housed (withdrawn) position. Thus, different operations are required to extend the writing medium and to withdraw it. Therefore, another problem is that the operation of withdrawing the writing medium and the knocking operation are not simple, but instead are unduly complicated.

SUMMARY OF THE INVENTION

In view of the foregoing and other problems, disadvantages, and drawbacks of the conventional knocking writing utensil, an object of the present invention is to provide a knocking writing utensil that facilitates a simple knocking operation and that enables the writing medium to automatically return to a withdrawn position when the clip is used.

To attain the above and other objects, a knocking writing utensil according to the invention, includes an external cylinder, a writing medium inserted and housed in the external cylinder so as to be movable in the axial direction, an elastic body for propelling the writing medium rearward, and a knock body that protrudes from the external cylinder to be knocked. In a knocking operation, the knock body is knocked (e.g., actuated, depressed, etc.) to move the writing medium between a withdrawn position within the external cylinder and a forward position where the writing medium tip protrudes from the tip of the external cylinder.

In the writing utensil, an engagement body for positioning the writing medium is preferably provided within the external cylinder. The engagement body has an engagingly-locking protrusion formed thereon. An engaging-lock receiving protruding portion, including an engaging-lock receiving portion at its front end, is formed on a back surface of a non-proximal end of a clip having its proximal end fixed to the external cylinder.

The external cylinder has a guide hole formed to correspond to the engaging-lock receiving protruding portion of the clip. The guide hole preferably is wider than the engaging-lock receiving protruding portion in only one lateral side of the hole relative to the engaging-lock receiving protruding portion.

The engagingly-locking protrusion of the engagement body engages the engaging-lock receiving portion of the clip through the guide hole to hold the writing medium at the forward position. The engagingly-locking protrusion disengages from the engaging-lock receiving portion and is placed behind the engaging-lock receiving protruding portion to hold the writing medium at the withdrawal position.

In the writing utensil, a knock bar is disposed inside the external cylinder. The knock bar is integratedly operated with the knock body, and has a cam portion that can be engaged with the engagement body.

The cam portion guides the engagingly-locking protrusion beyond the engaging-lock receiving protruding portion, from behind it, to the engaging-lock receiving portion. The cam portion also guides the engagingly-locking protrusion from the engaging-lock receiving portion to a position behind the engaging-lock receiving protruding portion, so as to pass by one lateral side of the engaging-lock receiving protruding portion.

In a writing operation, when the knock body is operated, the cam portion of the knock bar, integratedly operated with the knock body, engages the engagement body, to press the engagingly-locking protrusion of the engagement body forward against the resisting force of the elastic body.

The cam portion of the knock bar moves the engagingly-locking protrusion from behind, beyond the engaging-lock receiving protruding portion of the clip to the engaging-lock receiving portion located at the front end of the engaging-lock receiving protruding portion.

In this manner, the engagingly-locking protrusion engages with the engaging-lock receiving portion to hold the writing medium at the forward position such that its tip protrudes from the tip of the external cylinder. Thus, writing is possible.

When not writing, the knock body is operated again to make the cam portion of the knock bar engage with the engaging body so that, based on the urging force of the cam portion and elastic body, the engagingly-locking protrusion is moved from the engaging-lock receiving portion to behind the engaging-lock receiving protruding portion so as to bypass the engaging-lock receiving protruding portion.

Then, the engagingly-locking protrusion is disengaged from the engaging-lock receiving portion and placed behind the engaging-lock receiving protruding portion to hold the writing medium at the withdrawal position at which it is withdrawn into the external cylinder.

Optionally, the cam portion of the knock bar can engage the engagingly-locking protrusion of the engagement body. The cam portion of the knock bar has a first cam surface that guides the engagingly-locking protrusion from behind to a position beyond the engaging-lock receiving protruding portion to the engaging-lock receiving portion. The cam portion of the knock bar also has a second cam surface that guides the engagingly-locking protrusion from the engaging-lock receiving portion to behind the engaging-lock receiving protruding portion in an operation to pass by one lateral side of the engaging-lock receiving protruding portion. The first and second cam surfaces of the cam portion of the knock bar reliably guide the engagingly-locking protrusion through a predetermined route to prevent malfunction.

Optionally, besides the engagingly-locking protrusion, a cam receiving portion that engages with the cam portion of the knock bar can be formed on the engagement body. Since the cam receiving portion, as well as the engagingly-locking protrusion, are formed on the engagement body, the cam portion of the knock bar can stably guide the engagement body.

A knocking writing utensil according to another aspect of the present invention includes an external cylinder, a writing medium inserted and housed in the external cylinder so as to be moved in the axial direction, an elastic body for urging the writing medium rearward, and a knock body that is exposed outwardly from the side of the external cylinder to be knocked. The knock body is operated to move the writing medium between a withdrawn position in which it is withdrawn into the external cylinder and a forward position in which the writing medium tip protrudes from the tip of the external cylinder.

In the writing utensil, an engagement body, coupled to the writing medium to position it, is provided in the external cylinder and has an engagingly-lock protrusion formed thereon. An engaging-lock receiving protruding portion, having an engaging-lock receiving portion at its front end, is formed on a back surface of a non-proximal end of a clip having its proximal end fixed to the external cylinder.

The external cylinder has a guide hole formed therein corresponding to the engaging-lock receiving protruding portion of the clip. The guide hole is wider than the engaging-lock receiving protruding portion in only one lateral side of the hole relative to the engaging-lock receiving protruding portion. The guide hole has, at a front end opposed to the engaging-lock receiving portion, a front-end cam surface that gradually approaches a side where the engaging-lock receiving protruding portion does not exist, toward the front end of the cam surface.

The engagingly-locking protrusion is engaged with the engaging-lock receiving portion through the guide hole to hold the writing medium at the forward position, and is disengaged from the engaging-lock receiving portion and placed behind the engaging-lock receiving protruding portion to hold the writing medium in the withdrawal position.

The knock body is adapted to being knocked to move the writing medium forward, located at the withdrawal position, against the resisting force of the elastic body and also, to move the engagingly-locking protrusion beyond the engaging-lock receiving protruding portion, from behind it to the engaging-lock receiving portion.

Further, the knock body is adapted to being knocked to move the writing medium forward, from its location at the forward position, thereby causing the engagingly-locking protrusion to depart from the engaging-lock receiving portion and then to slide on the front-end cam surface. As a result, the engagingly-locking protrusion moves to a position behind the engaging-lock receiving protruding portion passing by one lateral side of the engaging-lock receiving protruding portion.

The knock body is operated to move the writing medium forward, from its location at the withdrawal position, against the resisting force of the elastic body. This moves the engagingly-locking protrusion of the engagement body, coupled to the writing medium, beyond the engaging-lock receiving protruding portion of the clip from behind it to the engaging-lock receiving portion installed at the front end of the engaging-lock receiving protruding portion. In this manner, the engagingly-locking protrusion is engaged with the engaging-lock receiving portion to hold the writing medium at the forward position where its tip protrudes from the tip of the external cylinder. Thus, writing is possible.

The knock body is operated to move the writing medium, from its location at the forward position, in a forward direction to cause the engagingly-locking protrusion to depart from the engaging-lock receiving portion and then to slide on the front-end cam surface. This moves the engagingly-locking protrusion to behind the engaging-lock receiving protruding portion so as to bypass the engaging-lock receiving protruding portion. In this manner, the engagingly-locking protrusion is disengaged from the engaging-lock receiving portion and is placed behind the engaging-lock receiving protruding portion, to hold the writing medium at the withdrawal position at which it is withdrawn into the external cylinder.

The engagement body may have a slit for bending the engagingly-locking protrusion in the direction of the inner diameter.

Upon interfering with (e.g., abutting) the engaging-lock receiving protruding portion of the clip, the engagingly-locking protrusion can be bent in the direction of the inner diameter to bypass the engagingly-lock receiving protruding portion and to move to the front side of the engagingly-lock receiving protruding portion. Then, the operator feels resistance through the knock body to confirm this operation, resulting in improved operability.

The engaging-lock receiving protruding portion may have at its rear an inclined surface (see FIG. 4(*c*), reference numeral 28*c*) that is inclined such that its height gradually decreases toward its rear end, and the engagingly-locking protrusion may have at its top an inclined surface (see FIG. 3(*a*), reference numeral 26*c*) that is inclined so that its height gradually decreases toward its frond end.

When the engagingly-locking protrusion contacts the engagingly-locking receiving protruding portion of the clip, the inclined surfaces of the engaging-lock receiving protruding portion and engagingly-locking protrusion slide across each other while being in contact to smoothly move the engagingly-locking protrusion beyond the engaging-lock receiving protruding portion.

The present disclosure relates to subject matter contained in Japanese Patent Application No. Hei 10-211655 and Japanese Patent Application No. Hei 11-190931, filed Jul.

27, 1998, and Jul. 5, 1999, respectively, which are expressly incorporated herein by reference in their entirety.

BRIEF DESCRIPTION OF THE DRAWINGS

The foregoing and other purposes, aspects and advantages will be better understood from the following detailed description of preferred embodiments of the invention with reference to the drawings, in which:

FIG. 3(*b*) is a plan view of the knock body and the engagement body according to the first embodiment of the present invention;

FIG. 3(*c*) is a side view of the knock body and the engagement body according to the first embodiment of the invention;

FIG. 4(*a*) is a side view of a clip according to the first embodiment;

FIG. 4(*b*) is a bottom view of the clip according to the first embodiment;

FIG. 4(*c*) is another view of the clip shown in FIG. 4(*a*) as seen from the direction shown by an arrow;

FIG. 9(*b*) is a plan view of the engagement body according to the second embodiment of the present invention;

FIG. 9(*c*) is a sectional view of the engagement body according to the second embodiment of the present invention taken along a line 9*c*—9*c* in FIG. 9(*b*);

FIG. 10(*b*) shows a plan view of the knock bar according to the second embodiment;

FIG. 10(*c*) shows a sectional view of the knock bar according to the second embodiment taken along a line 10*c*—10*c* in FIG. 10(*b*);

DESCRIPTION OF THE PREFERRED EMBODIMENTS

Figure 1:
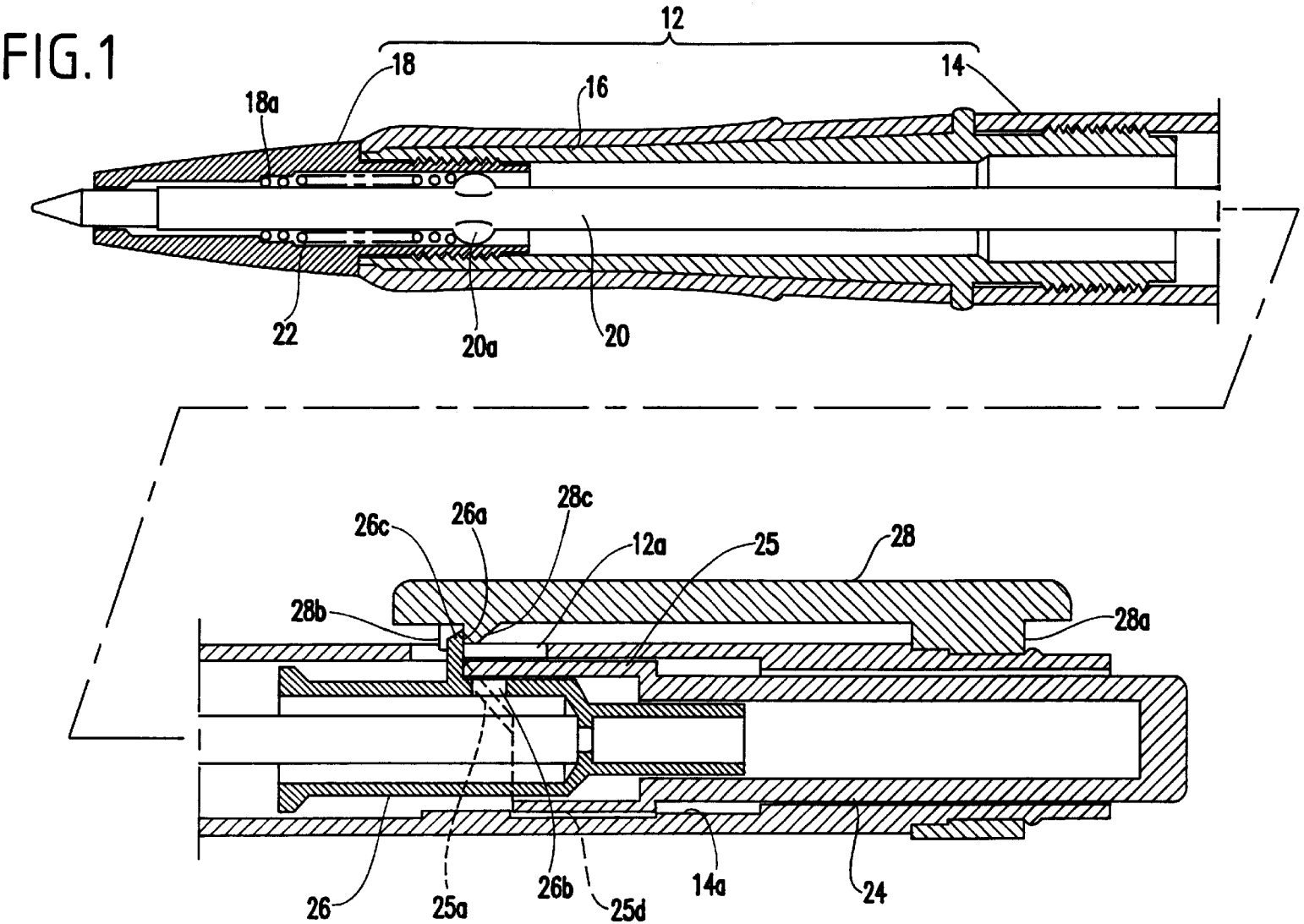
FIG. 1 shows a vertical sectional view of a first embodiment of a knocking writing utensil according to the present invention and shows a refill (e.g., a writing medium) at a forward position.

Referring now to the drawings, and more particularly to FIGS. 1–17, there are shown preferred embodiments of the method and structures according to the present invention.

First Embodiment

Figure 2:
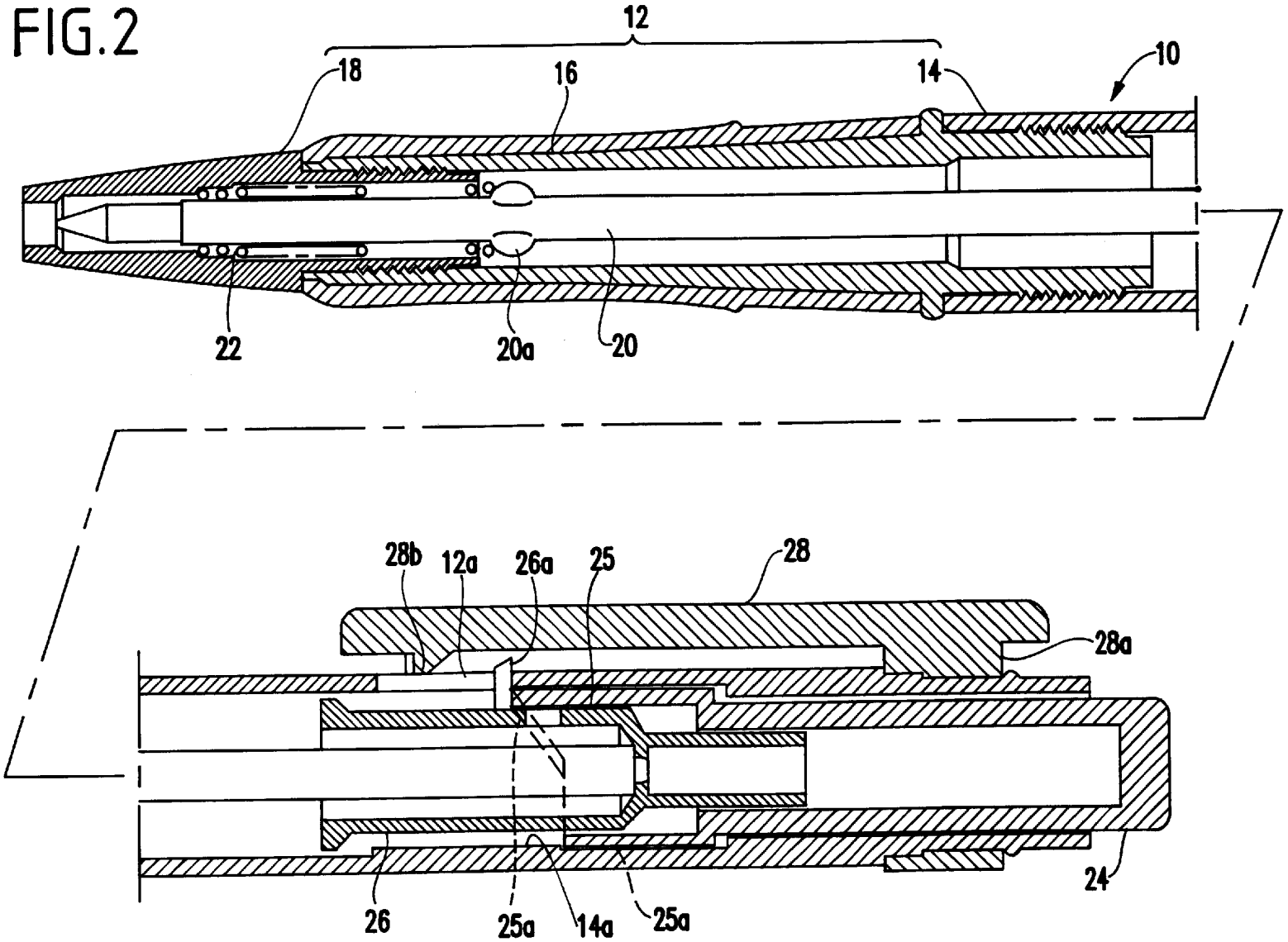
FIG. 2 shows a vertical sectional view of the first embodiment of the knocking writing utensil according to the present invention and shows the refill (e.g., the writing medium) at a withdrawal position.

FIGS. 1 and 2 are vertical sectional views showing a first embodiment of a knocking writing utensil according to the present invention. In the illustrated embodiment, the invention is applied to a writing utensil which is, for example, a ball-point pen and a writing medium which is, for example, a refill holding ink.

A knocking writing utensil 10 includes an external cylinder 12 including of a rear cylinder 14, a front cylinder 16 screwed in the tip of the rear cylinder 14, and a tip fitting 18 screwed in the tip of the front cylinder 16. A refill 20 as a writing medium is inserted and housed in the external cylinder 12 so as to be moved in the axial direction. A spring 22 that is an elastic body is interposed between a step portion 18*a* formed inside the tip fitting 18 and a spring receiver 20*a* formed on the refill 20, to apply continuous rearward pressure on the refill 20.

Figure 3A:
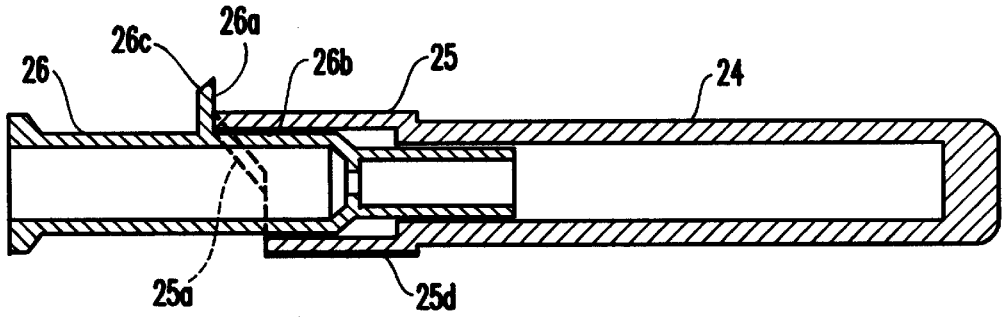
FIG. 3(*a*) shows a sectional view of a knock body and an engagement body according to the first embodiment of the present invention.
Figure 3B:
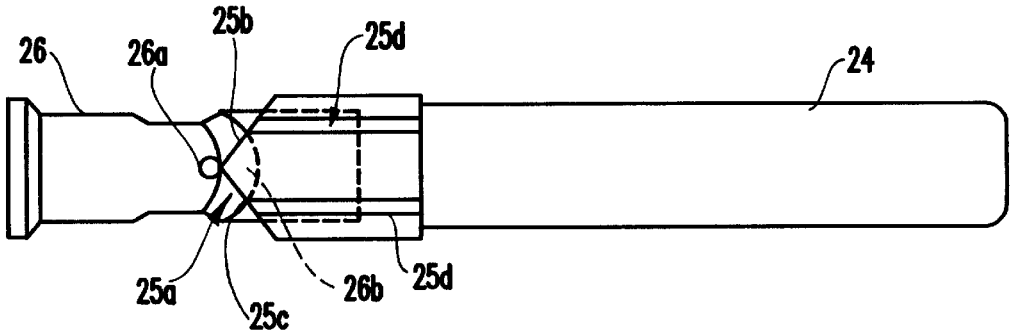
Figure 3C:
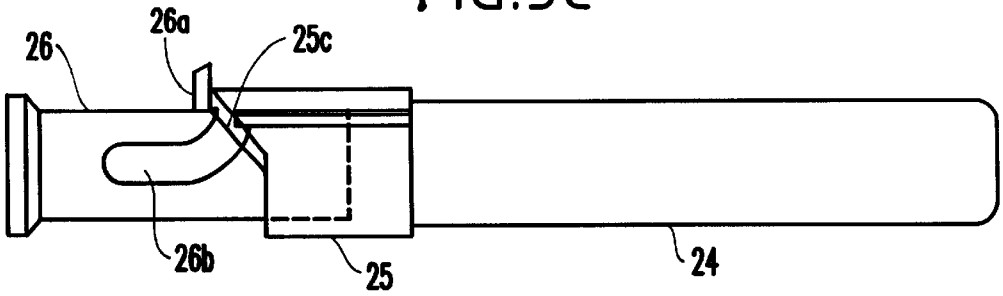

The rear end of the refill 20 is inserted into an engagement body 26 so that the engagement body 26 moves inside the external cylinder 12 together with the refill 20. The engagement body 26 includes on its circumferential surface, an engagingly-locking protrusion 26*a* protruding in the direction of the outer diameter. The circumferential surface of the engagement body 26 has a U-shaped hole 26*b* that is a slit surrounding the engagingly-locking protrusion 26*a* in three directions, as shown in FIGS. 3(*a*) to 3(*b*). The U-shaped hole 26*b* allows the engagingly-locking protrusion 26*a* to bend in a radially inward direction. In addition, the top of the engagingly-locking protrusion 26*a* has an inclined surface 26*c*, the height of which gradually decreases toward its front end.

The rear end of the engagement body 26 is slidably inserted into the knock bar 25. The knock bar 25 has, formed on its tip, a cam portion 25*a* that can abut the engagingly-locking protrusion 26*a* of the engagement body 26. The cam portion 25*a* is shaped to be sharper toward its tip, and both of the sides of cam portion 25*a* include a first cam surface 25*b* and a second cam surface 25*c*.

In addition, a plurality of vertical grooves 25*d* extending in the axial direction are formed on the outer circumferential surface of the knock bar 25. A vertical rib 14*a* is formed on the corresponding inner circumferential surface of the rear cylinder 14. The vertical grooves 25*d* and the vertical rib 14*a* are fitted together, to prevent the knock bar 25 from rotating relative to the external cylinder 12. The rear end of the knock bar 25 is integrated with the knock body 24, and the knock body 24 protrudes rearward from the rear cylinder 14 so as to be exposed outwardly. The knock body 24 and the knock bar 25 may also be separate and distinct parts.

A proximal end 28*a* of a clip 28 is fitted on the rear of the outer circumference of the external cylinder 12, while an engaging-lock receiving protruding portion 28*b* protruding toward the external cylinder 12 is formed on the back surface of a non-proximal end of the clip 28. As shown in FIG. 4(*a*), the engaging-lock receiving protruding portion 28*b* has an inclined surface 28*c*, formed on its rear, that is inclined so that its height gradually decreases toward its rear end.

In addition, as shown in FIG. 4(*b*), the engaging-lock receiving protruding portion 28*b* has at its front end a cam surface 28*d* that is inclined so that its width gradually decreases toward its front end. The cam surface 28*d* has connected to its rear end an engaging-lock receiving portion 28*e* that is open in a forward direction for accommodating the engagingly-locking protrusion 26*a*.

Figure 5:
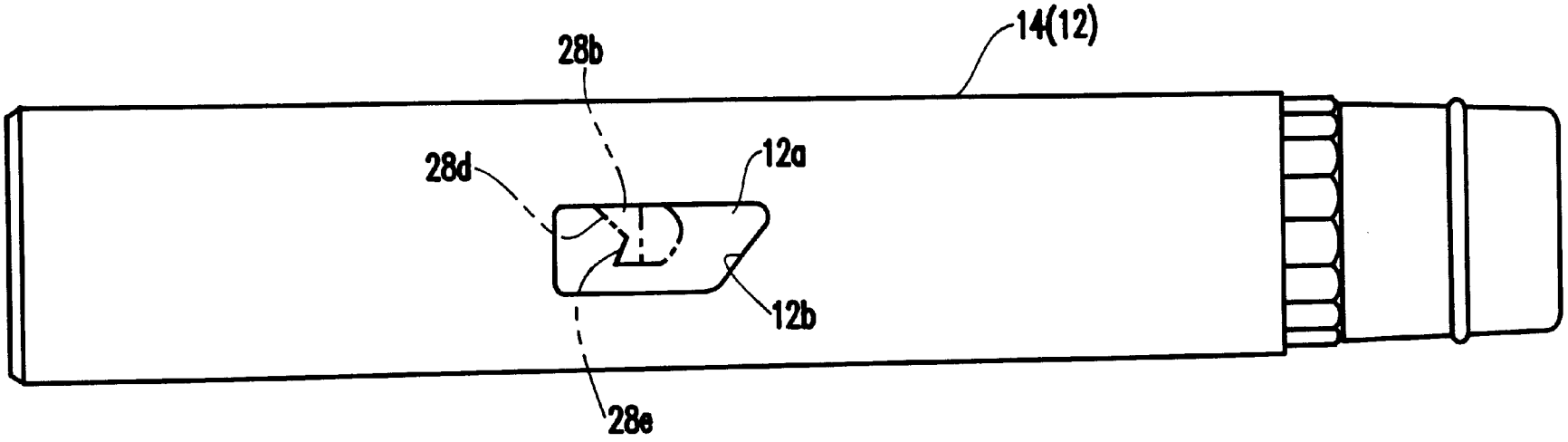
FIG. 5 shows a plan view of an external cylinder, (e.g., a rear cylinder) according to the first embodiment.
Figure 6A:
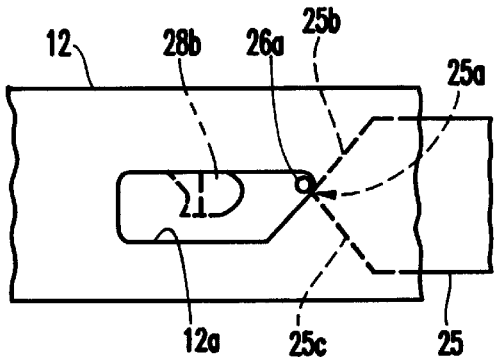
FIGS. 6(*a*) to 6(*f*) are explanatory drawings showing operations of a guide hole on the external cylinder and an engagingly-locking protrusion thereon according to the first embodiment.
Figure 6B:
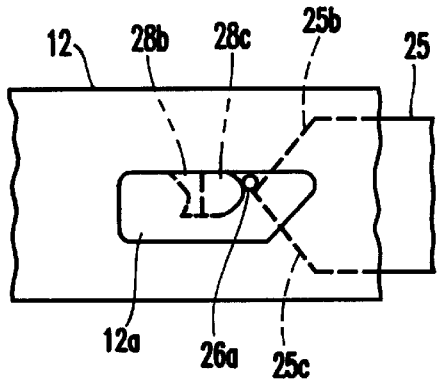
Figure 6C:
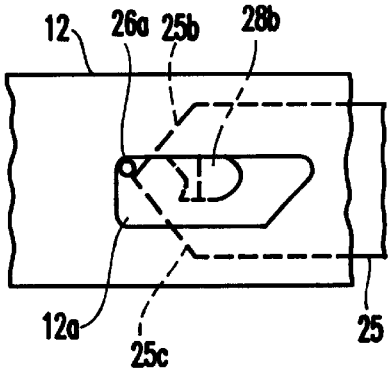
Figure 6D:
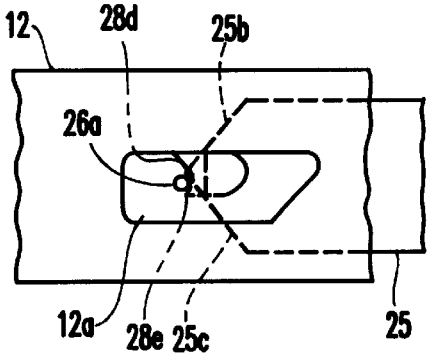
Figure 6E:
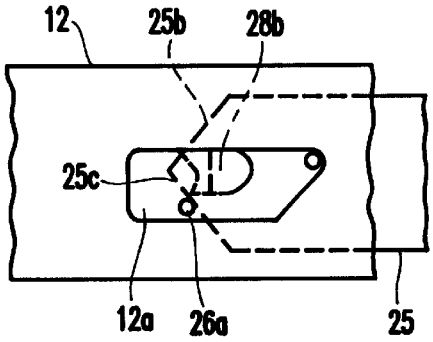
Figure 6F:
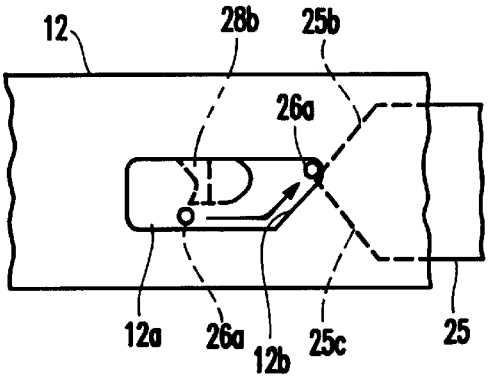
Figure 7:
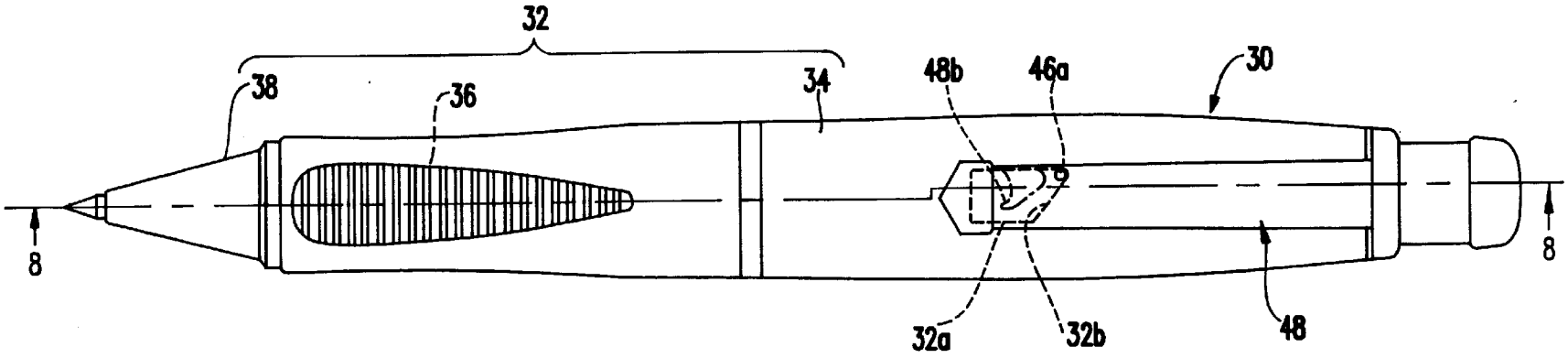
FIG. 7 shows a plan view of a second embodiment of the knocking writing utensil according to the present invention.

A guide hole 12*a* is formed, on the outer circumferential surface of the external cylinder 12 on rear cylinder 14, corresponding to the engaging-lock receiving protruding portion 28*b*. As shown in FIG. 5, the guide hole 12*a* is wider than the engaging-lock receiving protruding portion 28*b* (shown by an imaginary line) in only one lateral side of the hole relative to the engaging-lock receiving protruding portion 28*b*. The guide hole 12*a* has at its rear end (e.g., the narrower end) a cam surface 12*b* that gradually approaches a side where the engaging-lock receiving protruding portion 28*b* exists, toward the rear end of the surface 12*b*.

The engagingly-locking protrusion 26*a* of the engagement body 26 penetrates the guide hole 12*a*. In addition, the tip of the cam portion 25*a* of the knock bar 25 is set to be located on an axial line defining the boundary between the engaging-lock receiving portion 28*e* and the cam surface 28*d* as shown in FIG. 6 (*d*). The first cam surface 25*b* is located on the cam surface 28*d* side relative to the boundary, while the second cam surface 25*c* is located on the engaging-lock receiving portion 28*e* side.

An operation of the knocking writing utensil according to the first embodiment and configured in this manner will be described with reference to FIGS. 6(*a*) to 6(*f*).

When the writing utensil is not in use, the refill 20 is subject to rearward pressure exerted by the spring 22 which positions the refill 20 in the withdrawn position completely within the external cylinder 12. In the withdrawn position, the engagingly-locking protrusion 26*a* of the engagement body 26 abuts the guide hole 12*a* at the extreme rearward end of the cam surface 12*b* (e.g., see FIG. 6(*a*)) to inhibit the engagement body 26 and the refill 20 from moving further rearward.

Next, in a writing operation, the user knocks the knock body 24 forward in order to use the refill 20. The first cam surface 25*b* of the cam portion 25*a* of the knock bar 25 abuts the engagingly-locking protrusion 26*a* to push it forward (e.g., see FIG. 6(*b*)). The engagingly-locking protrusion 26*a* contacts the engaging-lock receiving protruding portion 28*b* of the clip 28, but can pass the engaging-lock receiving protruding portion 28*b*. This passing is possible because the inclined surface 28*c* of the engaging-lock receiving protruding portion 28*b* and the inclined surface 26*c* of the engagingly-locking protrusion 26*a* permit a sliding movement of the two parts while in contact. The engagingly-locking protrusion 26*a* uses its flexibility to slide into the external cylinder 12 along the inclined surface 28*c*.

The first cam surface 25*b* prevents the engagingly-locking protrusion 26*a* from being diverted in a lateral direction and from escaping from the engaging-lock receiving protruding portion 28*b*. The engagingly-locking protrusion 26*a* moves directly forward in the axial direction to pass the engaging-lock receiving protruding portion 28*b*.

After passing the engaging-lock receiving protruding portion 28*b*, the engagingly-locking protrusion 26*a* reaches the front end of the guide hole 12*a* (e.g., see FIG. 6(*c*)).

When the user reduces the force applied to the knock body 24, the spring 22 moves the refill 20 and the engagement body 28 rearward. The engagingly-locking protrusion 26*a* is guided by the first cam surface 25*b* of the cam portion 25*a* of the knock bar 25 to move straight and rearward in the axial direction without diverting laterally. The engagingly-locking protrusion 26*a* then abuts on the cam surface 28*d* of the engaging-lock receiving protruding portion 28*b*, and then slides on the surface 28*d* while maintaining contact therewith.

The engagingly-locking protrusion 26*a* then reaches the engaging-lock receiving portion 28*e* to engage therewith (e.g., see FIG. 6(*d*)). This engagement prohibits the rearward movement of the refill 20 to hold it at the forward position at which its tip protrudes from the tip of the external cylinder 12. Thus, the writing utensil is ready for use.

After using the writing instrument as discussed above, when the user knocks the knock body 24 again, the second cam surface 25*c* of the cam portion 25*a* of the knock bar 25 abuts on the engagingly-locking protrusion 26*a* to push it forward. This operation causes the engagingly-locking protrusion 26*a* to leave the engaging-lock receiving portion 28*e* and then to slide on the second cam surface 25*c* of the cam portion 25*a* of the knock bar 25 while maintaining contact with surface 25*c*.

In this manner, the engagingly-locking protrusion 26*a* moves to a side laterally opposite to a side where the engaging-lock receiving protruding portion 28*b* exists (e.g., see FIG. 6(*e*)). When the user stops applying force to the knock body 24, the engagingly-locking protrusion 26*a* moves rearward by passing through a neighborhood of the engaging-lock receiving protruding portion 28*b*, and then abuts on the cam surface 12*b*. The engagingly-locking protrusion 26*a* slides along in contact with the cam surface 12*b* to return to the rearmost end of this surface. Thus, the refill 20 returns to the withdrawn position and is housed in the external cylinder 12 (e.g., see FIG. 6(*f*)).

Since the proximal end 28*a* of the clip 28 is fixed to the external cylinder 12, the clip 28 does not move in response to the knocking of the knock body 24 and the knocking operation of the knock body 24 is possible despite the gripping of the clip 28, thereby improving operability.

Further, the knock body 24 is knocked to return the refill 20 to the withdrawn position. That is, the forward and the withdrawn positions can be switched by simply knocking the knock body 24, thereby further improving operability.

In addition, during the forward movement, in which force is applied to the knock body 24, the engagingly-locking protrusion 26*a* of the engagement body 26 is forced to slide under the engaging-lock receiving protruding portion 28*b* of the clip 28 which creates resistance detectable by the operator in confirmation of this operation.

Conversely, when no force is applied to the knock body 24 being moved rearwardly, the engagingly-locking protrusion 26*a* passes through a section of the engaging-lock receiving protruding portion 28*b* of the clip 28. Consequently, the engagingly-locking protrusion 26*a* operates smoothly without being stopped in its movement prior to reaching the rearmost end.

If the user forgets to house the refill 20 in the withdrawn position, and the refill 20 is in the forward position, when the user moves the external cylinder 12 away from the non-proximal end of the clip 28 to put the writing utensil in a pocket, then the engaging-lock receiving portion 28*e* and the engagingly-locking protrusion 26*a* are disengaged from each other. This causes the refill 20 to be automatically moved rearward to the withdrawn position due to the force exerted by the spring 22. This operation and structure of the invention can prevent ink from staining the pocket if a user tries to clip the writing instrument without withdrawing the writing tip.

The engagingly-locking protrusion 26*a* protruding from the guide hole 12*a* in the external cylinder 12, in the direction of the outer diameter, can be bent in the radially inward direction. Accordingly, during assembly, this flexibility can be used to press the engagement body 26 in from the front of the rear cylinder 14 in order to assemble it into the cylinder 14.

Second Embodiment

Referring to FIGS. 7 to 12, a second embodiment of the invention will be described below.

A knocking writing utensil 30 includes an external cylinder 32 including a rear cylinder 34, a front cylinder 36 fitted (e.g., screwed) into the tip of the rear cylinder 34, and a tip fitting 38 screwed into the tip of the front cylinder 36. A refill 40, as a writing medium, is inserted and housed in the external cylinder 32 so as to be moved in the axial direction. A spring 42 that is an elastic body is interposed between a step portion 38*a* formed inside the tip fitting 38 and a spring receiver 40*a* formed on the refill 40 in order to apply constant tension on the refill 40 in a rearward direction.

Figure 9A:
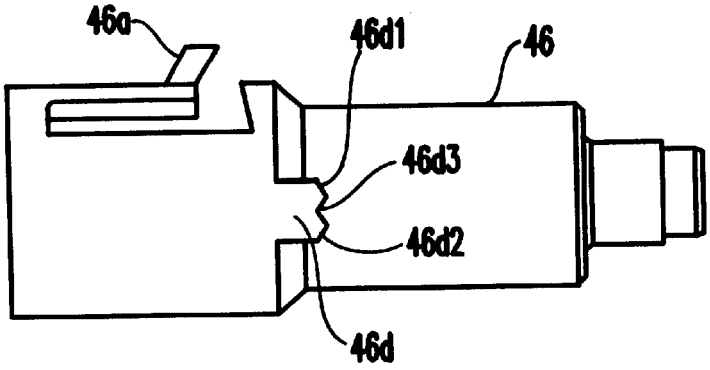
FIG. 9(*a*) is a side view of an engagement body according to the second embodiment of the present invention.
Figure 9B:
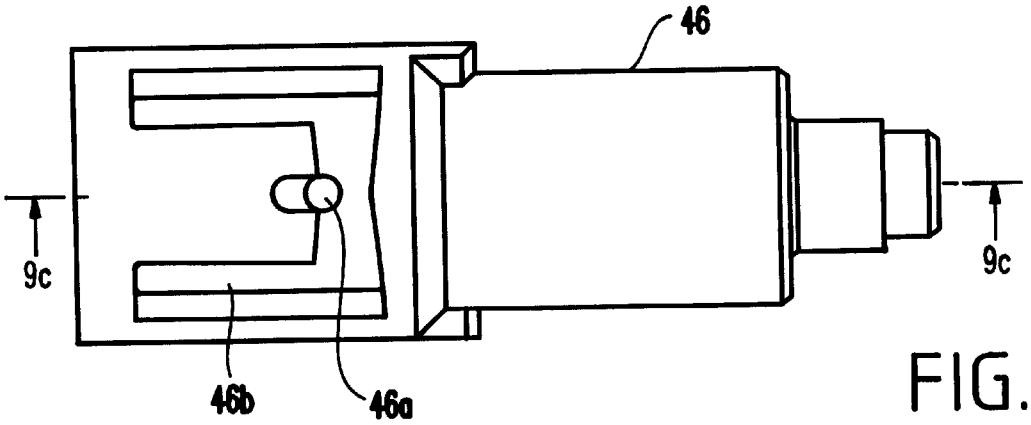
Figure 9C:
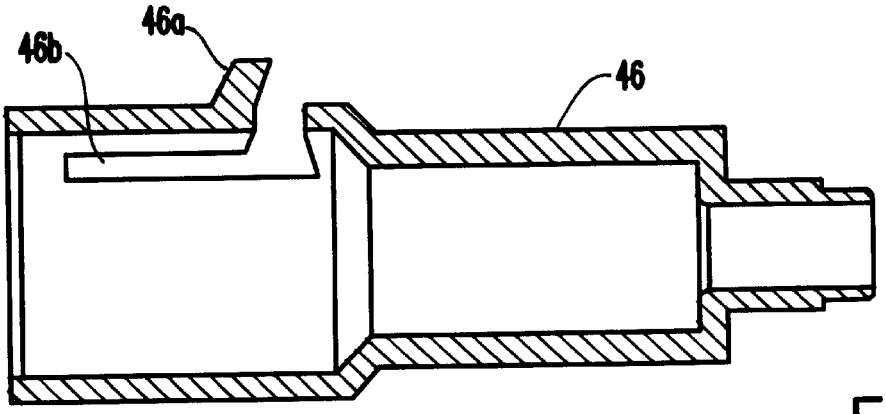

The rear end of the refill 40 is inserted into an engagement body 46 so that the engagement body 46 moves inside the external cylinder 32 together with the refill 40. The engagement body 46 has, formed on its circumferential surface, an engagingly-locking protrusion 46*a*. The engagingly-locking protrusion 46*a* protrudes in the direction of the outer diameter, and has a U-shaped hole 46*b* formed in the circumferential surface that is a slit surrounding the engagingly-locking protrusion 46*a* in a plurality (e.g., three) directions, as shown in FIG. 9(*b*). The U-shaped hole 46*b* enables the engagingly-locking protrusion 46*a* to bend in a radially inward direction.

In addition, a cam receiving portion 46*d* is formed behind the engagingly-locking protrusion 46*a* of the engagement body 46 and away from the engagingly-locking protrusion 46*a* through approximately ±90°, as seen from the circumferential direction. The cam receiving portion 46*d* engages a cam portion 45*a* of a knock bar 45. The cam receiving portion 46*d* has first and second cam surfaces, 46*d*1 and 46*d*2, that each form an inclined surface, and a recessed portion 46*d*3 formed at the intersection between the first and second cam surfaces 46*d*1 and 46*d*2.

Figure 10A:
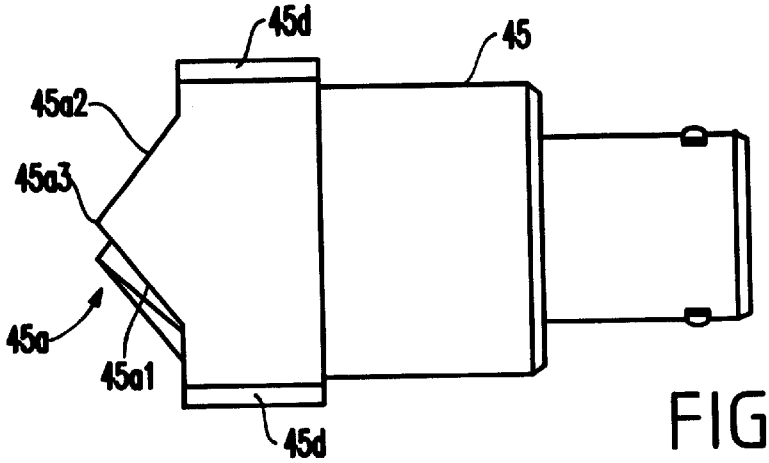
FIG. 10(*a*) shows a side view of a knock bar according to the second embodiment.
Figure 10B:
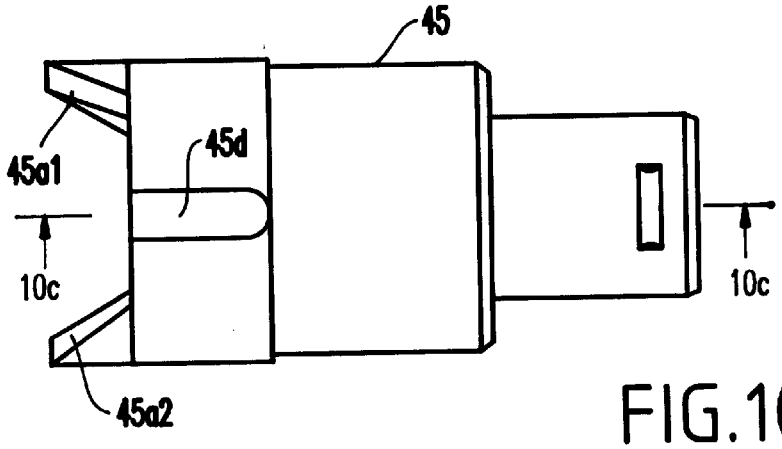
Figure 10C:
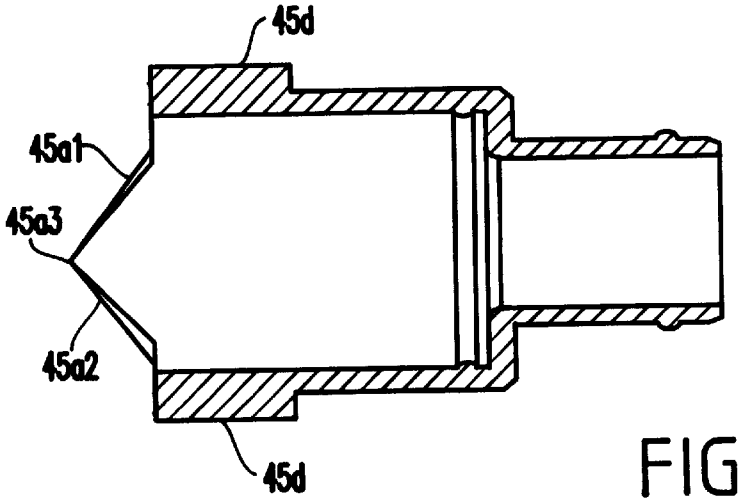

The rear end of the engagement body 46 is slidably inserted into the knock bar 45. The knock bar 45 has formed at its tip the cam portion 45*a* that engages with the cam receiving portion 46*d* of the engagement body 46, as shown in FIG. 10(*a*) in detail.

The cam portion 45*a* has first and second cam surfaces, 45*a*1 and 45*a*2, that each form an inclined surface and a top 45*a*3 located at the intersection between the first and second cam surfaces 45*a*1 and 45*a*2 and shaped to be sharper toward the tip. In addition, a plurality of vertical ribs 45*d* extending in the axial direction are formed in the outer circumferential surface of the knock bar 45, and vertical grooves 34*a* are formed on the corresponding inner circumferential surface of the rear cylinder 34. Thus, the vertical ribs 45*d* and the vertical grooves 34*a* are fitted together to prevent the knock bar 45 from rotating relative to the external cylinder 32.

The rear end of the knock bar 45 is pressed into the knock body 44 so as to integrate the knock bar 45 with the knock body 44, and the knock body 44 protrudes rearward from the rear cylinder 34 so as to be exposed outwardly. A spring 47 is interposed between the knock body 44 and the engagement body 46 to urge them so as to space them in the axial direction.

Figure 8:
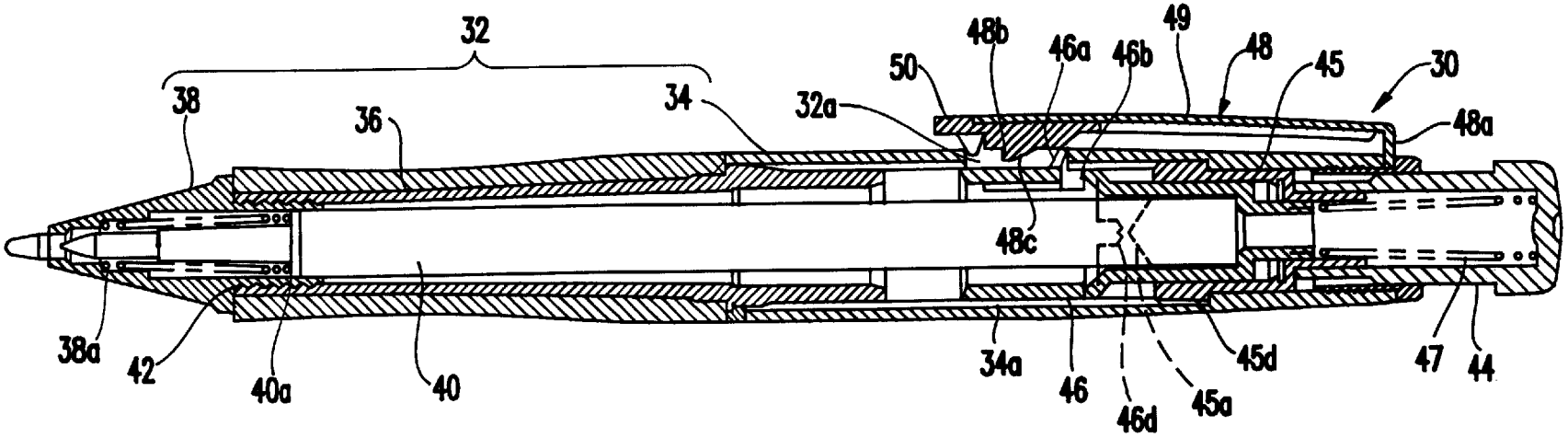
FIG. 8 shows a view of the knocking writing utensil according to the present invention taken along a line 8—8 in FIG. 7.

A proximal end 48*a* of a clip 48 is fitted on the rear of the outer circumference of the external cylinder 32. The clip 48 may include one piece (e.g., be integrally formed) as in the first embodiment, but according to the second embodiment, includes a clip body 49 preferably made of metal and a plastic clip decoration 50 attached to a non-proximal end of the clip body 49. An engaging-lock receiving protruding portion 48*b* protruding toward the external cylinder 32 is formed on the back surface of the clip decoration 50. The engaging-lock receiving protruding portion 48*b* has, formed in its rear, an inclined surface 48*c* that is inclined such that its height gradually decreases toward its rear end (FIG. 8).

Figure 11:
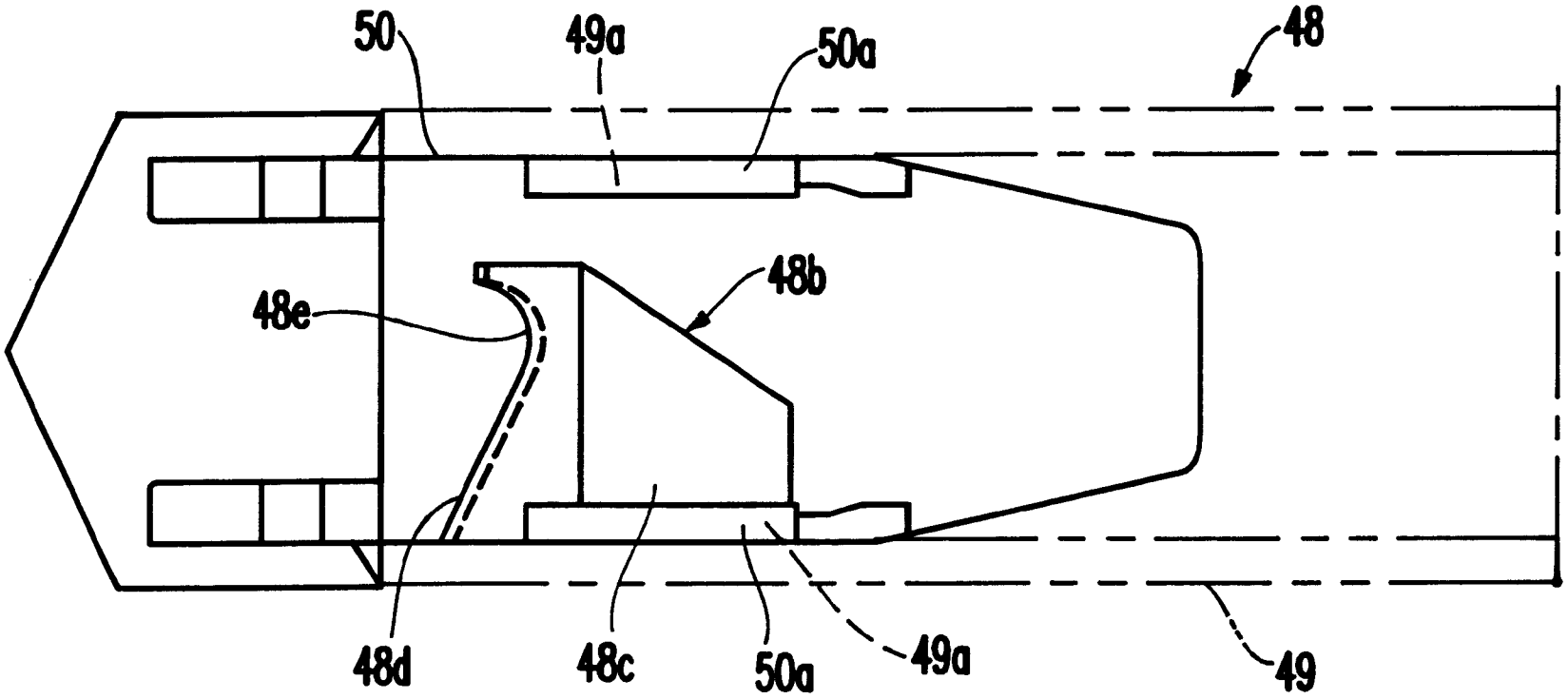
FIG. 11 shows the rear surface of a clip according to the second embodiment.
Figure 12A:
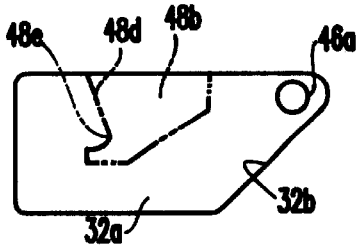
FIGS. 12(*a*) to 12(*f*) are explanatory drawings showing operations of a guide hole on the external cylinder and an engagingly-locking protrusion thereon according to the second embodiment (e.g., see figures on lefthand side of drawing sheet) as well as operations of a cam receiving portion and a cam portion according to the second embodiment (e.g., see figures on right hand side of drawing sheet)
Figure 12A:
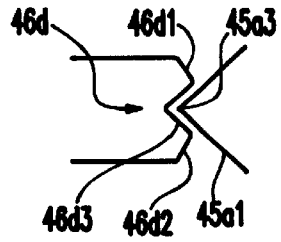
Figure 12B:
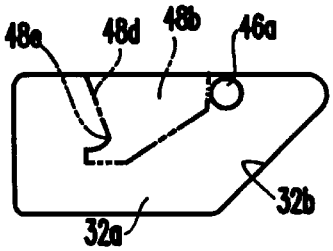
Figure 12B:
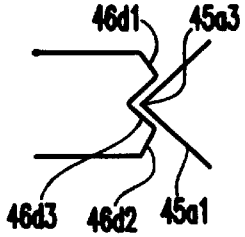
Figure 12C:
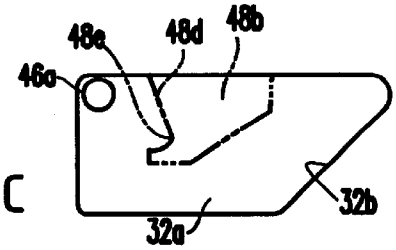
Figure 12C:
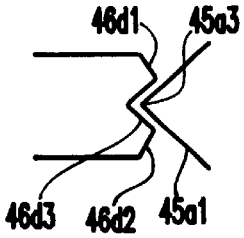
Figure 12D:
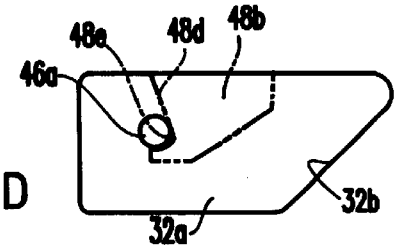
Figure 12D:
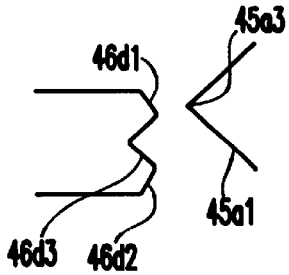
Figure 12E:
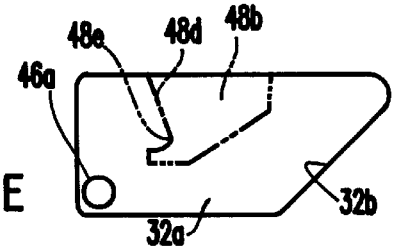
Figure 12E:
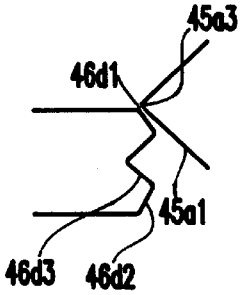
Figure 12F:
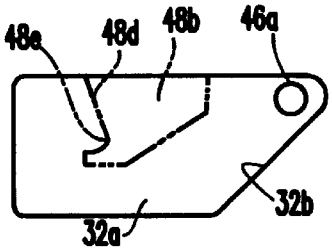
Figure 12F:
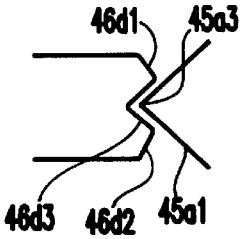

In addition, as shown in FIG. 11, the engaging-lock receiving protruding portion 48*b* has at its front end a cam surface 48*d* that is inclined such that its width gradually decreases toward its front end. The cam surface 48*d* has connected to its rear end an engaging-lock receiving portion 48*e* that is open forwardly and that can accommodate the engagingly-locking protrusion 46*a*. In addition, as shown in FIG. 11, recessed portions 50*a* for receiving a protruding portion 49*a* of the clip body 49 are formed in both sides of the rear surface of the clip decoration 50.

A guide hole 32*a* is formed on the outer circumferential surface of the external cylinder 32 at the rear cylinder 34 so as to correspond to the engaging-lock receiving protruding portion 48*b*. As shown by the dotted line in FIG. 7, the guide hole 32*a* is wider than the engaging-lock receiving protruding portion 48*b* (e.g., shown by an imaginary line) in only one lateral side of the hole relative to the engaging-lock receiving protruding portion 48*b*. The guide hole 32*a* has at its rear end a cam surface 32*b* that gradually approaches a side where the engaging-lock receiving protruding portion 48*b* exists, toward the rear end of the surface 32*b*.

The engagingly-locking protrusion 46*a* of the engagement body 46 penetrates the guide hole 32*a*. In addition, the top 45*a*3 of the cam portion 45*a* of the knock bar 45 is set to be located on the same axial line as the recessed portion 46*d*3 when the refill 40 is at the withdrawal position at which it is inside the external cylinder 32.

An operation of the knocking writing utensil according to the second embodiment and configured in this manner will be described with reference to FIG. 12.

When the writing utensil is not in use, the refill 40 is under tension in a rearward direction by the spring 42. This keeps the refill 40 in the withdrawn position in which it is entirely housed in the external cylinder 32. At this time, the engagingly-locking protrusion 46*a* of the engagement body 46 abuts the guide hole 32*a* at the rearmost end of the cam surface 32*b* (e.g., see FIG. 12(*a*)) to inhibit the engagement body 46 and the refill 40 from moving further rearward.

Next, when the user knocks the knock body 44 forward in order to use the refill 40, the top 45*a*3 of the cam portion 45*a* of the knock bar 45 engages the recessed portion 46*d*3 of the cam receiving portion 46*d* of the engagement body 46 to push the engagement body 46 forward (e.g., see FIG. 12(*b*)). The engagingly-locking protrusion 46*a* of the engagement body 46 interferes with (e.g., abuts) the engaging-lock receiving protruding portion 48*b* of the clip 48, but can pass the engaging-lock receiving protruding portion 48*b*. The engagingly-locking protrusion 46*a* can slide past the engaging-lock receiving protruding portion 48*b* by sliding on the inclined surface 48*c* of the engaging-lock receiving protruding portion 48*b*.

Contact is maintained between the engagingly-locking protrusion 46*a* and the engaging-lock receiving protruding portion 48*b* as the engagingly-locking protrusion 46*a* slides past the engaging-lock receiving protruding portion 48*b*. Due to its flexibility, the engagingly-locking protrusion 46*a* slides into the external cylinder 32 along the inclined surface 48*c*. As the top 45*a*3 of the cam portion 45*a* is engaged with the recessed portion 46*d*3 of the cam receiving portion 46*d*, the engagingly-locking protrusion 46*a* is prevented from being diverted in the lateral direction.

Therefore as a result, the engagingly-locking protrusion 46*a* moves straight forwardly in the axial direction to pass the engaging-lock receiving protruding portion 48*b*. After passing the engaging-lock receiving protruding portion 48*b*, the engagingly-locking protrusion 46*a* reaches the front end of the guide hole 32*a* (e.g., see FIG. 12(*c*)).

When the user reduces the force applied to the knock body 44, the spring 42 moves the refill 40 and the engagement body 46 rearwardly. While the top 45*a*3 of the cam portion 45*a* of the knock bar 45 remains engaged with the recessed portion 46*d*3, the engagingly-locking protrusion 46*a* moves rearwardly in a straight line in the axial direction without being diverted laterally and abuts the cam surface 48*d* of the engaging-lock receiving protruding portion 48*b*.

When the force applied to the knock body 44 is further reduced, the recessed portion 46*d*3 of the engagement body 46 and the top 45*a*3 of the cam portion 45*a* are disengaged from each other. This disengagement causes the engagingly-locking protrusion 46*a* to slide on the cam surface 48*d* while maintaining contact therewith. The engagingly-locking protrusion 46*a* then reaches the engaging-lock receiving portion 48*e* to engage it (e.g., see FIG. 12(*d*)). This engagement prohibits the rearward movement of the refill 40 and holds it at the forward position where its tip protrudes from the tip of the external cylinder 32.

As a result of the operation above, the writing utensil is ready for use. The knock body 44 is returned to its rearward position because of the tension supplied by the spring 47.

When the user knocks the knock body 44 when the writing utensil is ready for use, the first cam surface 45*a*1 of the cam portion 45*a* of the knock bar 45 abuts the first cam surface 46*d*1 of the cam receiving portion 46*d* of the engagement body 46 to push it forward. This operation causes the engagingly-locking protrusion 46*a* of the engagement body 46 to disengage from the engaging-lock receiving portion 48*e*, and then to move to a side laterally opposite to a side of the engaging-lock receiving protruding portion 48*b* (e.g., see FIG. 12(*e*)).

When the user stops applying force to the knock body 44, the engagingly-locking protrusion 46*a* moves rearwardly through the section with the engaging-lock receiving protruding portion 48*b*, and then abuts on the cam surface 32*b*. The engagingly-locking protrusion 46*a* slides on the cam surface 32*b* and maintains contact with the cam surface 32*b* to return to the rear most end of this surface (e.g., see FIG. 12(*f*)). Thus, the refill 40 returns to the withdrawal position and is housed in the external cylinder 32.

The above configuration provides benefits similar to those of the first embodiment. In addition, according to the second embodiment, the cam receiving portion 46*d* is formed separately from the engagingly-locking protrusion 46*a*, so that the cam portion 45*a* of the knock bar 45 can guide the engagement body 46 stably.

Third Embodiment

Figure 13:
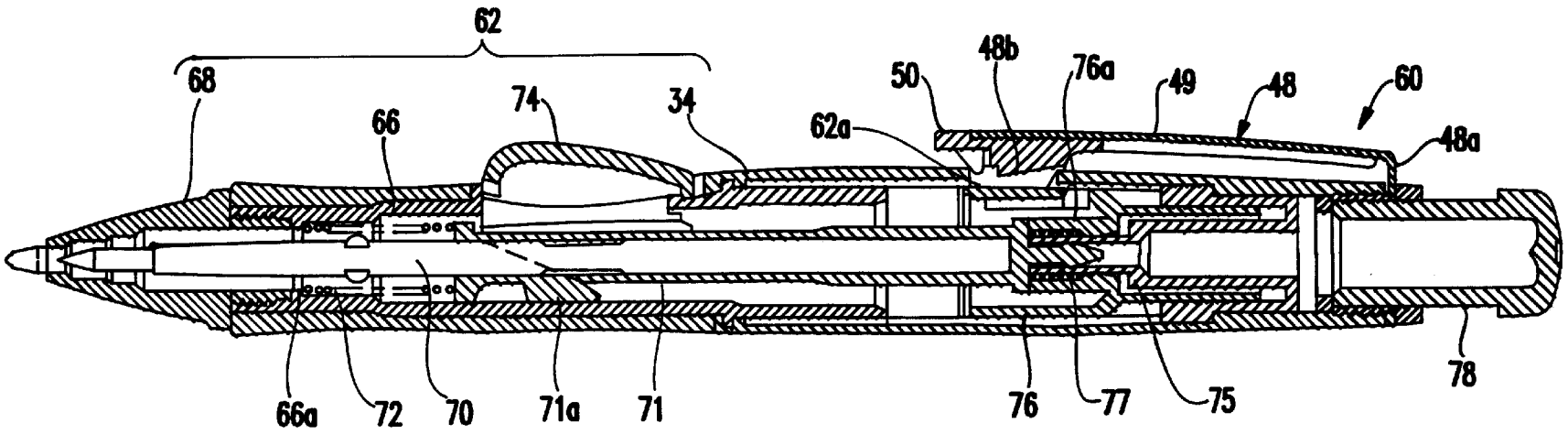
FIG. 13 shows a vertical sectional view of a third embodiment of the knocking writing utensil according to the present invention.
Figure 14:
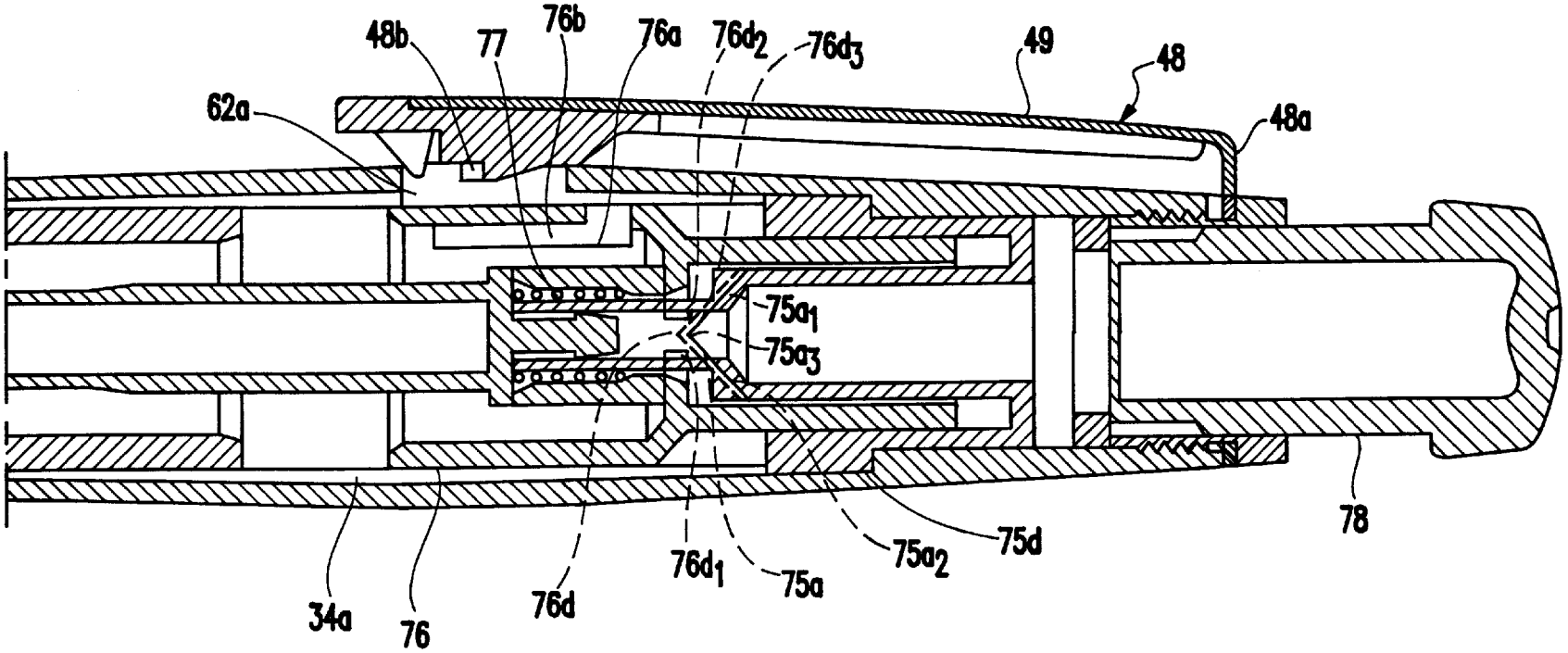
FIG. 14 shows a partially enlarged view of a rear portion of FIG. 13.

Referring to FIGS. 13 and 14, a third embodiment of the invention will be described below.

Although the first and second embodiments have been described in conjunction with the rear-end knocking writing utensil in which the knock bodies (e.g., 24 and 44, respectively) protrude from the rear end of the external cylinders (e.g., 12 and 32, respectively), the third embodiment of the invention differs in that it includes a knock body on the side of an external cylinder. The knock body can be knocked in the radial direction or slidably knocked in the axial direction. Thus, the third embodiment is directed to a side knock writing utensil.

A side knock writing utensil 60 includes an external cylinder 62 including a front cylinder 66 screwed in the tip of the rear cylinder 34 and a tip fitting 68 screwed in the tip of the front cylinder 66. A refill 70, as a writing medium, is inserted and housed in the external cylinder 62, and the refill 70 moves in the axial direction. A spring 72 that is an elastic body is interposed between a step portion 66*a* formed inside the front cylinder 66 and the front end of a refill receiver 71. The rear end of the refill 70 is inserted into the refill receiver 71 such that the refill receiver 71 and the refill 70 are integrated together. The spring 72 constantly urges the refill 70 and the refill receiver 71 rearwardly.

The refill receiver 71 has, formed in its front, a knock receiving portion 71*a* the diameter of which is increased relative to the refill receiver and that has a rear end surface acting as a cam surface. In addition, a swingable knock body 74 is attached to the circumferential surface of the front cylinder 66. When the knock body 74 is knocked from the side and is swung into the front cylinder 66, the cam surface of the knock receiving portion 71*a* is pushed forward.

An engagement body 76 abuts the rear end of the refill receiver 71, so that the refill receiver 71 and the refill 70 can be positioned by adjusting the position of the engagement body 76. As shown in the enlarged view in FIG. 14, the engagement body 76 has, on its circumferential surface, an engagingly-locking protrusion 76*a*, a U-shaped hole 76*b*, and a cam receiving portion 76*d* that are identical to the engagingly-locking protrusion 46*a*, the U-shaped hole 46*b*, and the cam receiving portion 46*d* according to the second embodiment of the invention.

The engagingly-locking protrusion 76*a* can be bent in the radially inward direction. The cam receiving portion 76*d* also has first and second cam surfaces 76*d*1 and 76*d*2, each including an inclined surface, and a recessed portion 76*d*3 formed at the intersection between the first and second cam surfaces 76*d*1 and 76*d*2, as in the second embodiment.

The rear end of the refill receiver 71 is coupled to the knock bar 75. The knock bar 75 has formed thereon a cam portion 75*a* that engages the cam receiving portion 76*d* of the engagement body 76. This configuration is the same as the cam portion 45*a* of the knock bar 45 in the second embodiment.

The cam portion 75*a* has first and second cam surfaces, 75*a*1 and 75*a*2, that each include an inclined surface, and a top 75*a*3 located at the intersection between the first and second cam surfaces 75*a*1 and 75*a*2 and shaped to be sharper toward the tip. In addition, a plurality of vertical ribs 75*d* extending in the axial direction are formed in the outer circumferential surface of the knock bar 75, and the vertical ribs 75*d* are fitted in the corresponding vertical grooves 34*a* in the rear cylinder 34 to prevent the knock bar 75 from rotating relative to the external cylinder 62.

A spring 77 is provided on the inner circumferential surface of the engagement body 76, and is interposed between the engagement body 76 and the refill receiver 71 to urge the engagement body 76 rearward relative to the refill receiver 71, (e.g., toward the knock bar 75). Thus, the spring 77 serves to urge the cam receiving portion 76*d* of the engagement body 76 so as to abut it on the cam portion 75*a*. The spring 77 is selected to have a weaker spring force than the spring 72.

A rear-end cap 78 is attached to the rear end of the external cylinder 62. The clip 48 is fitted in the rear of the outer circumference of the external cylinder 62. The clip 48 and the guide hole 62*a* in the outer circumferential surface of the external cylinder 62 are the same as in the second embodiment, so its detailed description is omitted.

The operation of the side knock writing utensil according to the third embodiment and configured in this manner is also similar to the operation of the second embodiment of the invention described in the preceding sections.

When the user knocks the knock body 74, to move the refill 70 forward into a writing position, the knock body 74 moves the refill receiver 71 forward which in turn moves forward the knock bar 75 coupled to the refill receiver 71. This permits the cam portion 75*a* of the knock bar 75 and the cam receiving portion 76*d* of the engagement body 76 to perform the same operations as shown in FIGS. 12(*a*) to 12(*d*) referred to with respect to the second embodiment.

Thus, the engagingly-locking protrusion 76*a* of the engagement body 76 engages the engaging-lock receiving portion 48*e*, and the engagement body 76 prohibits the refill 70 from moving rearwardly. As a result, the refill 70 is held at the forward position at which its tip protrudes from the tip of the external cylinder 62.

After the writing operation is finished, when the user knocks the knock body 74 again for withdrawing the writing tip into the body of the writing instrument, the knock body 74 moves the refill receiver 71 forward which moves forward the knock bar 75 coupled to the refill receiver 71. This operation permits, the cam portion 75*a* of the knock bar 75 and the cam receiving portion 76*d* of the engagement body 76, to perform the same operations as shown in FIGS. 12(*e*) to 12(*f*).

Thus, the refill 70 returns to the withdrawn position where its tip has retreated behind the tip of the external cylinder 62 so as to be completely housed in the external cylinder 62. These operations provide benefits similar to those described in the preceding embodiments.

Fourth Embodiment

Figure 15:
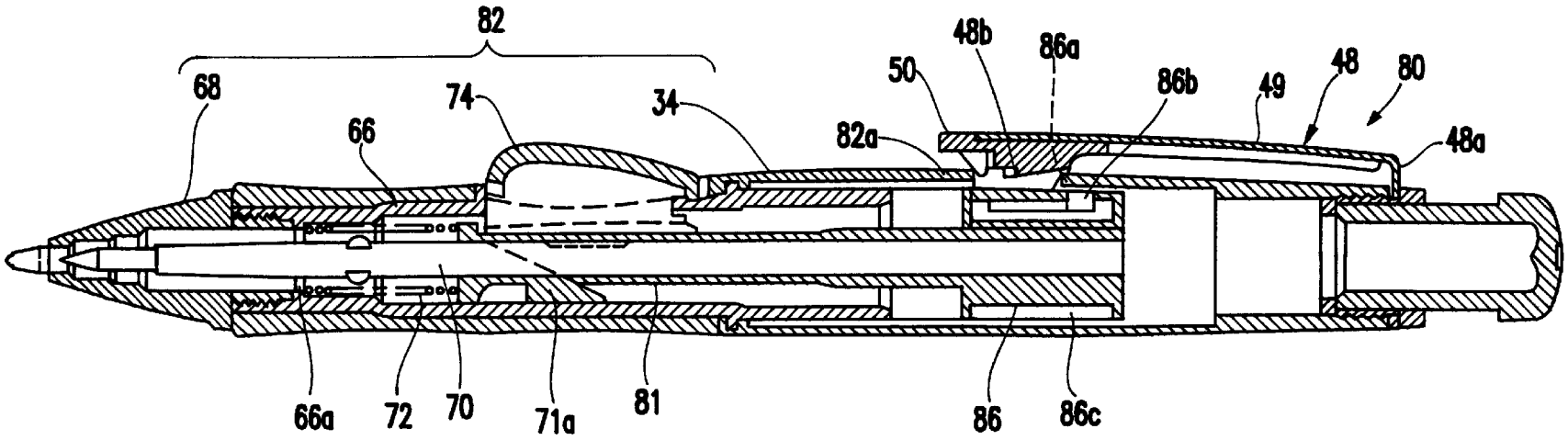
FIG. 15 shows a vertical sectional view of a fourth embodiment of the knocking writing utensil according to the present invention.
Figure 16:
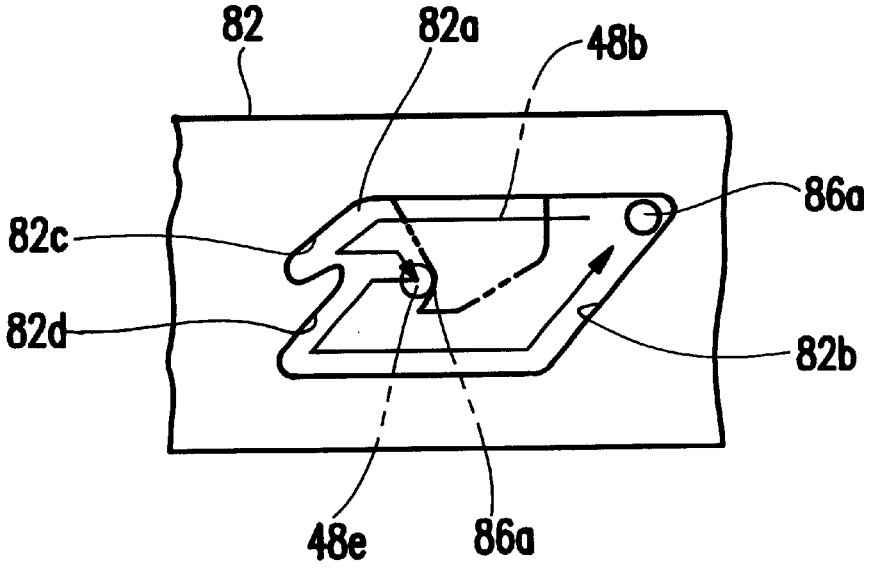
FIG. 16 shows a view showing a guide hole in an external cylinder according to the fourth embodiment.
Figure 17:
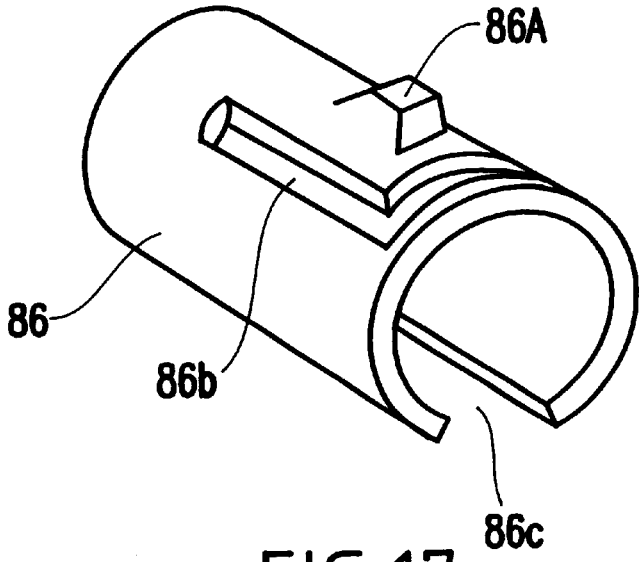
FIG. 17 shows a perspective view showing an engagement body according to the fourth embodiment.

Referring to FIGS. 15 to 17, a fourth embodiment of the present invention will be described below.

In these figures, the same members as in the embodiments of the invention described previously have the same reference numerals, and their detailed description is omitted. The fourth embodiment differs from the above embodiments in that it is a side knock writing utensil and requires a smaller number of parts than the third embodiment of the invention.

An engagement body 86 in a knocking writing utensil 80, according to a fourth embodiment of the invention, has an engagingly-locking protrusion 86*a*, a U-shaped hole 86*b*, and a slit 86*c* located 180° away from the engagingly-locking protrusion 86*a* in the circumferential direction. The slit 86*c* fits the engagement body 86 on the rear end of the refill receiver 81 so that the engagement body 86 can be moved inside the external cylinder 82 integrally with the refill receiver 81 which supports the rear end of the refill 70. As a result, the knock bar 75 and the spring 77 can be omitted.

In addition, as shown in FIG. 16, the guide hole 82*a* in the external cylinder 82 is wider than the engaging-lock receiving protruding portion 48*b* (e.g., shown by an imaginary line) in only one lateral side of the hole relative to the engaging-lock receiving protruding portion 48*b*.

The guide hole 82*a* has, formed at its rear end, a rear-end cam surface 82*b* that gradually approaches a side where the engaging-lock receiving protruding portion 48*b* exists, toward the rear end of the surface 82*b*. In addition, the guide hole 82*a* has at its front end, a front-end first cam surface 82*c* that gradually approaches a side where the engaging-lock receiving protruding portion 48*b* is not formed, toward the front end of the cam surface 82*b*, as well as a front-end second cam surface 82*d* connected to the front-end first cam surface 82*c*.

In the side knock writing utensil configured in this manner, when the user knocks the knock body 74 to move the refill 70 forward. The knock body 74 moves the refill receiver 81 forward which in turn moves forward the engagement body 86 coupled to the rear end of the refill receiver 81.

This operation induces a cooperative operation between the engagingly-locking protrusion 86*a* of the engagement body 86 and the engaging-lock receiving protruding portion 48*b*, as shown in the left half of FIGS. 12(*a*) to 12(*d*). Then, the engagingly-locking protrusion 86*a* moves, as shown by the arrow in FIG. 16, and engages with the engaging-lock receiving portion 48*e*. In this manner, the refill 70 is held at a forward position in which its tip protrudes from the tip of the external cylinder 82.

After using the writing instrument with the refill 70 in a forward position, when the user knocks the knock body 74, the knock body 74 moves the refill receiver 71 forwardly. The forward movement of the refill receiver 71 moves forward the engagement body 86 coupled to the refill receiver 71. Then, as shown by the arrow in FIG. 16, the engagingly-locking protrusion 86*a* of the engagement body 86 leaves the engaging-lock receiving portion 48*e*, reaches the front-end second cam surface 82*d*. The engagingly-locking protrusion 86*a* slides on the second cam surface 82*d* and maintaining contact therewith moves to the side laterally opposite to the side with the engaging-lock receiving protruding portion 48*b*.

When the user stops applying force to the knock body 74, the engagingly-locking protrusion 86*a* moves rearwardly passing through the section where the engaging-lock receiving protruding portion 48*b* is located, and then abuts the rear-end cam surface 82*b*. The engagingly-locking protrusion 86*a* slides on the rear-end cam surface 82*b* while maintaining contact therewith to return to the rearmost end of this surface. Thus, the refill 70 returns to the withdrawn position and is housed in the external cylinder 82.

To perform this withdrawal operation reliably, the boundary between the front-end first and second cam surfaces, 82*c* and 82*d*, is formed closer to the lateral side where the engaging-lock receiving protruding portion 48*b* exists than to the side opposite to the engaging-lock receiving portion 48*e*.

As described above, the fourth embodiment provides all the benefits of the embodiments of the invention described previously and additionally further reduces the number of required parts, thereby simplifying the structure of the invention.

Although the above examples have been shown in conjunction with the application of the invention to a ball-point pen as a writing utensil, the invention is not limited to this application. The invention is also applicable to a mechanical pencil wherein a lead delivery mechanism is used as a writing medium to allow the knock body to move the lead delivery mechanism from the withdrawal position to the forward position. This invention can also be applied to a "magic marker" using, as a writing medium, a holder that contains and holds ink or a felt core.

Furthermore, although in the above embodiments, the engagement body, the refill, and the refill receiver are separate from one another, this invention is not limited thereto and the writing medium and the engagement body can be integrally formed as one piece.

As described above, the proximal end of the clip is fixed to the external cylinder to prevent the clip from moving in response to the knocking of the knock body while enabling the knock body to be operated despite the gripping of the clip, thereby improving operability.

In addition, as with typical knocking writing utensils, the writing medium can be switched between the forward and withdrawal positions by simply knocking the knock body, thereby further improving operability. Also, if the user attempts to house the writing utensil in a pocket with the writing medium still fixed at the forward position, then as soon as the non-proximal end of the clip is moved, the engagingly-locking protrusion and the engaging-lock receiving portion are disengaged from each other. This disengagement permits the writing medium to return to the withdrawal position. This operation and feature of the invention can prevent the writing medium from staining or damaging a user's pocket and clothing.

While the invention has been described in terms of several preferred embodiments those skilled in the art will recognize that the invention can be practiced with modification within the spirit and scope of the appended claims.

Having thus described our invention, what we claim as new and desire to secure by Letters Patent is as follows:

1. A knocking writing utensil comprising:

an external cylinder having a guide hole formed therein;

a writing medium housed in the external cylinder so as to be movable in an axial direction;

an elastic body for urging the writing medium rearwardly;

a knock body exposed outwardly from the external cylinder to be knocked, wherein the knock body operates to move the writing medium between a withdrawal position at which the writing medium is withdrawn into said external cylinder and a forward position at which a tip of said writing medium protrudes from a tip of said external cylinder;

a clip with its proximal end fixed to said external cylinder;

an engagement body, provided within said external cylinder, for positioning the writing medium;

an engagingly-locking protrusion formed on said engagement body;

an engaging-lock receiving protruding portion including an engaging-lock receiving portion at its front end being formed on a back surface of a non-proximal end of said clip, said guide hole being formed in the external cylinder so as to correspond to said engaging-lock receiving protruding portion of the clip, wherein the guide hole is wider than said engaging-lock receiving protruding portion in only one lateral side of the guide hole relative to said engaging-lock receiving protruding portion, wherein said engagingly-locking protrusion is engaged with said engaging-lock receiving portion through said guide hole to hold the writing medium at the forward position and is disengaged from said engaging-lock receiving portion and placed behind said engaging-lock receiving protruding portion to hold the writing medium at the withdrawal position; and a knock bar, disposed inside said external cylinder, being integratedly operated with the knock body and including a cam portion, said cam portion being engageable with said engagement body, said cam portion guiding said engagingly-locking protrusion beyond said engaging-lock receiving protruding portion from behind it to said engaging-lock receiving portion and guiding said engagingly-locking protrusion from said engaging-lock receiving portion to behind said engaging-lock receiving protruding portion so as to pass by one lateral side of said engaging-lock receiving protruding portion.

2. The knocking writing utensil according to claim 1, wherein said engagement body includes a slit formed therein for bending said engagingly-locking protrusion in a direction of an inner diameter.

3. The knocking writing utensil according to claim 2, wherein the engaging-lock receiving protruding portion includes an inclined surface that is inclined such that its height gradually decreases toward its rear end, and wherein the engagingly-locking protrusion includes an inclined surface that is inclined such that its height gradually decreases toward its front end.

4. A knocking writing utensil comprising:

an external cylinder;

a writing medium housed in the external cylinder so as to be movable in an axial direction;

an engagement body, provided in the external cylinder, for positioning the writing medium, said engagement body including an engagingly-locking protrusion;

an elastic body for urging the writing medium rearwardly;

a knock body exposed outwardly from a side of said external cylinder to be knocked, and a clip coupled to the external cylinder and including an engaging-lock receiving portion for engaging with said engagingly-locking protrusion of said engagement body, wherein said knock body operates to move the writing medium between a withdrawal position at which it is withdrawn into the external cylinder and a forward position at which its tip protrudes from the top of an external cylinder.

5. The knocking writing utensil according to claim 4 wherein said engagement body includes a slit formed therein for bending the engagingly-locking protrusion in a direction of an inner diameter.

6. The knocking writing utensil according to claim 4, said clip including an engaging-lock receiving protruding portion, said engaging-lock receiving protruding portion including the engaging-lock receiving portion, wherein a guide hole is formed in the external cylinder so as to correspond to the engaging-lock receiving protruding portion of the clip.

7. The knocking writing utensil according to claim 6, wherein the guide hole is wider than the engaging-lock receiving protruding portion in only one lateral side of the hole relative to the engaging-lock receiving protruding portion.

8. The knocking writing utensil according to claim 7, wherein the engagingly-locking protrusion of an engagement body is engaged with said engaging-lock receiving portion through said guide hole to hold the writing medium at a first position, and is disengaged from said engaging-lock receiving portion and placed behind the engaging-lock receiving protruding portion to hold the writing medium in a second position.

9. The knocking writing utensil according to claim 8, further comprising:

a knock bar disposed inside said external cylinder, being integratedly operated with the knock body, said knock bar including a cam portion engageable with the engagement body, said cam portion guiding said engagingly-locking protrusion of the engagement body beyond said engaging-lock receiving protruding portion from behind it to said engaging-lock receiving portion and guiding said engagingly-locking protrusion of the engagement body from said engaging-lock receiving portion to behind said engaging-lock receiving protruding portion so as to pass by one lateral side of said engaging-lock receiving protruding portion.

10. A knocking writing utensil, comprising:

an external cylinder including a guide hole formed therein;

a writing medium housed in said external cylinder so as to be movable in an axial direction;

an elastic body for urging the writing medium rearwardly;

a knock body exposed outwardly from a side of said external cylinder to be knocked, wherein said knock body operates to move the writing medium between a first position and a second position;

a clip with its proximal end fixed to said external cylinder;

an engagement body, provided in the external cylinder for positioning the writing medium;

an engagingly-locking protrusion formed on said engagement body;

an engaging-lock receiving protruding portion including an engaging-lock receiving portion at its front end formed on a back surface of a non-proximal end of the clip; and a knack bar, disposed inside said external cylinder, being integratedly operated with the knock body, said knock bar operates to move the engagement body so that the engagingly-locking protrusion of the engagement body is received by the engaging-lock receiving portion of the engaging-lock receiving protruding portion or is removed from the engaging-lock receiving portion of the engaging-lock receiving protruding portion.

11. The knocking writing utensil according to claim 10, wherein said guide hole corresponding to the engaging-lock receiving protruding portion of the clip, and wherein said guide hole is wider than the engaging-lock receiving protruding portion in only one lateral side of the guide hole relative to the engaging-lock receiving protruding portion.

12. The knocking writing utensil according to claim 10, wherein said engagingly-locking protrusion engages with said engaging-lock receiving portion through said guide hole to hold the writing medium at the first position and disengages from the engaging-lock receiving portion and is placed behind said engaging-lock receiving protruding portion to hold the writing medium at the second position.

13. The knocking writing utensil according to claim 10, wherein said knock body is knocked to move forward the writing medium located at said second position to move said engagingly-locking protrusion beyond said engaging-lock receiving protruding portion from behind it to said engaging-lock receiving portion.

14. The knocking writing utensil according to claim 10, wherein said knock body is knock to move forward the writing medium located at said first position to cause said engagingly-locking protrusion to depart from said engaging-lock receiving portion and then to slide on said front-end cam surface to move said engagingly-locking protrusion to behind said engaging-lock receiving protruding portion so as to pass by a lateral side of said engaging-lock receiving protruding portion.

15. The knocking writing utensil according to claim 10, wherein said engaging-lock receiving protruding portion has in its rear an inclined surface that is inclined such that its height gradually decreases toward its rear end, and wherein said engagingly-locking protrusion has at its top an inclined surface that is inclined such that its height gradually decreases toward its frond end.

16. The knocking writing utensil according to claim 10, wherein said first position comprises a forward position of said writing medium and said second position comprises a withdrawn position of said writing medium.

17. A knocking writing utensil comprising:

an external cylinder including a guide hole formed therein;

a writing medium housed in said external cylinder so as to be moveable in an axial direction;

an elastic body for urging the writing medium rearwardly;

a knock body exposed outwardly from a side of said external cylinder to be knocked;

a clip with its proximal end fixed to said external cylinder;

an engagement body, provided in the external cylinder for positioning the writing medium;

an engaging-lock protrusion formed on said engagement body; and an engaging-lock receiving protruding portion including an engaging-lock receiving portion at its front end formed on a back surface of a non-proximal end of the clip, wherein said knock body operates to move the writing medium between a first position and a second position, wherein said guide hole corresponding to the engaging-lock receiving protruding portion of the clip, and wherein said guide hole is wider that the engaging-lock receiving protruding portion in only one lateral side of the guide hole relative to the engaging-lock receiving protruding portion.

18. A knocking writing utensil comprising:

an external cylinder including a guide hole formed therein;

a writing medium housed in said external cylinder so as to be moveable in an axial direction;

an elastic body for urging the writing medium rearwardly;

a knock body exposed outwardly from a side of said external cylinder to be knocked;

a clip with its proximal end fixed to said external cylinder;

an engagement body, provided in the external cylinder for positioning the writing medium;

an engaging-lock protrusion formed on said engagement body; and an engaging-lock receiving protruding portion including an engaging-lock receiving portion at its front end formed on a back surface of a non-proximal end of the clip;

wherein said knock body operates to move the writing medium between a first position and a second position; and wherein said knock body is knocked to move forward the writing medium locate at said first position to cause said engagingly-locking protrusion to depart from said engaging-lock receiving portion and then to slide on said front-end cam surface to move said engagingly-locking protrusion to behind said engaging-lock receiving protruding portion so as to pass by a lateral side of said engaging-lock receiving protruding portion.

* * * * *